United States Patent [19]

Tsuzuki et al.

[11] Patent Number: 4,864,273

[45] Date of Patent: Sep. 5, 1989

[54] VARIABLE RESISTOR

[75] Inventors: Takoyoshi Tsuzuki, Toyota; Mitsuko Kotaki, Chiryu; Ryohei Yabuno; Masami Ishii, both of Toyota, all of Japan

[73] Assignee: Aisin Seiki Kabushiki Kaisha, Kariya City, Japan

[21] Appl. No.: 221,575

[22] Filed: Jul. 20, 1988

[30] Foreign Application Priority Data

Jul. 22, 1987 [JP] Japan ..... 62-183070
Sep. 22, 1987 [JP] Japan ..... 62-237717

[51] Int. Cl.[4] ..... H01C 10/34

[52] U.S. Cl. ..... 338/174; 338/309; 338/320; 338/334

[58] Field of Search ..... 338/174, 160, 163, 162, 338/176, 183, 188, 307–309, 334, 320

[56] References Cited

U.S. PATENT DOCUMENTS 3,851,253 11/1974 Clayton ..... 338/142
3,961,302 6/1976 Hufford ..... 338/174
4,243,969 1/1981 Steigerwald et al. ..... 338/142 X

*Primary Examiner*—C. L. Albritton
*Attorney, Agent, or Firm*—Banner, Birch, McKie & Beckett

[57] ABSTRACT

A variable resistor having a multi-layer resistive/conductive element is provided. The resistor has three electrodes, a resistive element connecting two of the electrodes and a sliding contact between the resistive element and the third electrode. The base of the resistor is provided with test areas. Each of the test areas contains a strip of the material used to form an individual layer in the multi-layer element. The test areas provide a convenient means for measuring the thickness of the individual layers in the multi-layer element without having to destroy the resistor.

11 Claims, 2 Drawing Sheets

VARIABLE RESISTOR

BACKGROUND OF THE INVENTION

1. Field of the Invention

The present invention relates to an electric variable resistor having a resistive element with a layered structure.

2. Description of the Prior Art

Japanese Laid-Open Patent No. 61 (1986) - 119622 shows a variable resistor in which the resistive element has a two-layer structure. The volume inherent resistance of the upper resistive layer is from 2 to 500 times the volume inherent resistance of the lower resistive layer. The variable resistor has good durability, resistive stability and output stability.

In conventional variable resistors, the resistive element is a two-layer laminate. The ends of the laminate are typically covered with a conductive paint or paste at the point where they are joined to an electrode or other electrical contact, making it difficult to independently measure the thickness of the individual layers. Once the resistor has been made, the only way to measure the thickness of a layer is to cut through the resistive laminate and view its cross section.

It is also extremely difficult to control the thickness of the individual layers of the resistive element during the manufacturing process. This is a serious problem from a quality assurance standpoint since, for example, if the resistive layer is too thin, the durability is reduced. If the resistive layer is thicker or thinner than the target value, the resistive value of the variable resistor becomes nonstandard.

SUMMARY OF THE INVENTION

Accordingly, it is an object of the present invention to provide a variable resistor having a laminated resistive element in which the thickness of the individual layer(s) can be easily measured without cutting the product.

These and other objects are achieved by a variable resistor comprising:

an insulating base;

first, second and third electrodes mounted on the base;

a resistive element formed on the base and extending between the first electrode and the second electrode;

a first conductive cover formed on the base and providing a conductive contact between the resistive element and the first electrode;

a second conductive cover formed on the base and providing a conductive contact between the resistive element and the second electrode.

a contact member slidably disposed over the resistive element, the contact member being in sliding conductive contact with the resistive element and in conductive contact with the third electrode;

a first test area on said base, said first test area being made of the same material and having substantially the same thickness as said resistive element, said first test area being provided for estimating the thickness of said resistive element;

a second test area on said base, said second test area being made of the same material and having substantially the same thickness as each of said conductive covers, said second test area being provided for estimating the thickness of said conductive covers.

DETAILED DESCRIPTION OF THE INVENTION

Figure 1:
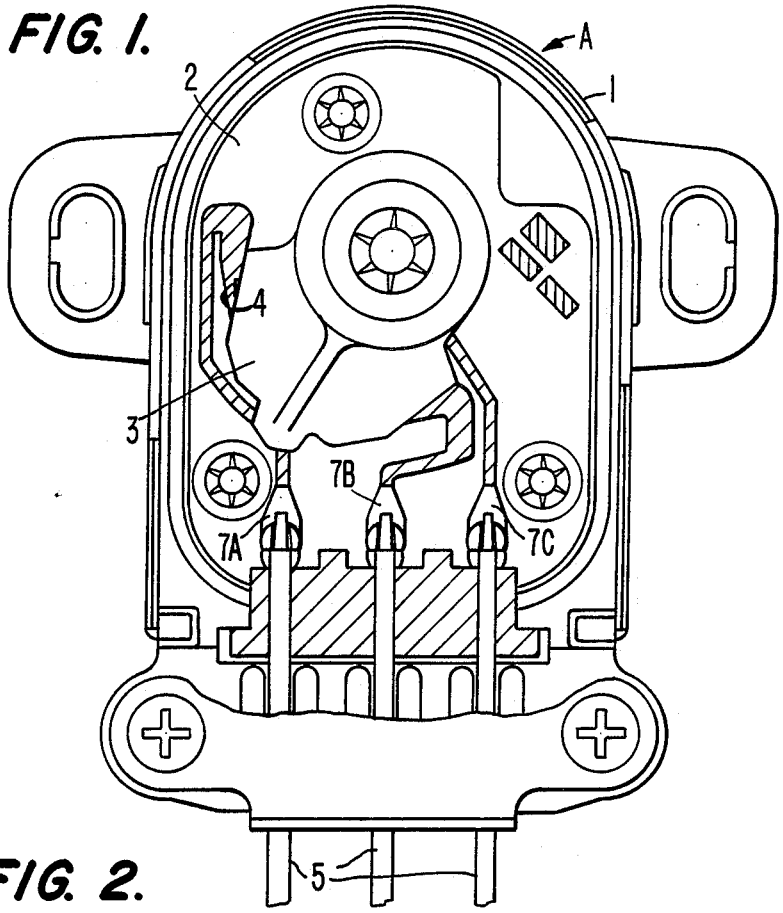
FIG. 1 is a top view of a variable resistor according to the present invention with portions of the outer casing removed to show the interior configuration of the resistor.

Referring to FIG. 1, variable resistor A comprises a body 1, a base 2, a brush holder 3, a sliding brush 4 and electrical leads 5. As will be readily appreciated by those skilled in the art, the third electrode 7C is in conductive contact with the brush 4. Brush 4 is in sliding conductive contact with resistive element 14. The resistive value between the first electrode 7A and the third electrode 7C, or between the second electrode 7B and the third electrode 7C, can be varied by suitably sliding the brush 4 along the length of the resistive element 14 which extends between electrodes 7A and 7B.

Figure 2:
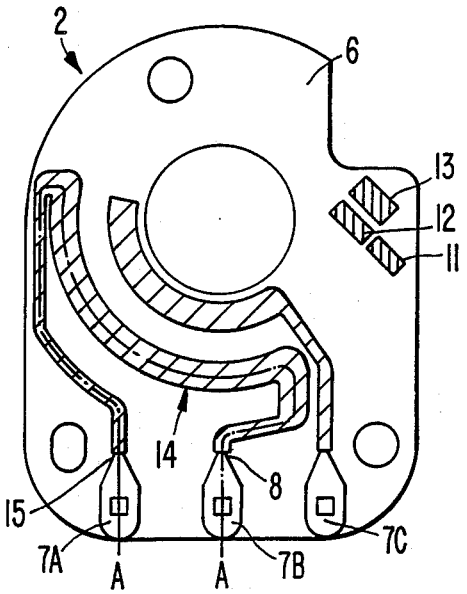
FIG. 2 is a top view of the base 2 shown in FIG. 1.
Figure 3:
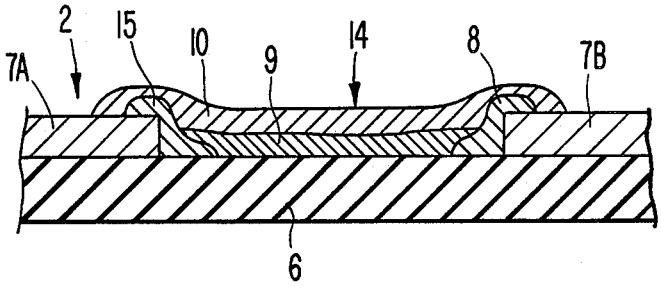
FIG. 3 is a sectional view of the base 2 and electrodes 7A, 7B taken along line A—A in FIG. 2.

As shown in FIGS. 2 and 3, the base 2 comprises an insulating plate 6 having mounted thereon the first electrode 7A, the second electrode 7B and the third electrode 7C. The two-layer resistive element 14 is formed (such as by painting or screen printing the two layers) on plate 6 in a line extending between electrodes 7A and 7B and having the configuration shown in FIG. 2. The ends of the resistive element 14 are in conductive contact with electrodes 7A and 7B, respectively. Electrical loss between the ends of element 14 and each of electrodes 7A and 7B is minimized by painting or screen printing a conductive material in the region of the joint. Thus, a conductive cover 8 is provided between the end of element 14 and electrode 7B while a conductive cover 15 is provided between the other end of element 14 and electrode 7A.

The resistive element 14 comprises a lower resistive layer 9 and an upper resistive layer 10 as best shown in FIG. 3. The volume inherent resistance of the upper resistive layer 10 is from 2 to 500 times the volume inherent resistance of the lower resistive layer 9. The two-layer structure of the resistive element 14 provides the variable resistor A with excellent durability and resistive stability.

As is explained in detail hereinafter, the base 2 is provided with a measurable test area 11 for estimating the thickness of the conductive covers 8 and 15, a measurable test area 12 for estimating the thickness of the lower resistive layer 9, and a measurable test area 13 for estimating the thickness of the upper resistive layer 10.

The base 2 may be made as follows: the conductive covers 8, 15 and the test area 11 are simultaneously screen printed on the base 2. A paste or paint containing a heat fusible binder and a powdered metal which is electrically conductive is preferably used to form covers 8, 15 and test area 11. One suitable material is a heat fusible silver paste sold by Asahi Chemical Co., Ltd., under the designation LS-504J. The binder in the paste is hardened using a thermoset process. The surface of base 2 is preferably composed of an epoxy resin or paper impregnated with a phenol resin, which has been etched in a predetermined pattern to accommodate the copper foil electrodes 7.

Next, the lower resistive layer 9 and test area 12 are simultaneously screen printed. The layer 9 is screen printed over the conductive covers 8, 15 and base 2 while the test area 12 is screen printed directly on base 2 in a similar manner. The printing material is a heat fusible carbon paste sold by Asahi Chemical Co., Ltd., under the designation BTU-350. The binder in the carbon paste is then hardened using a thermoset process.

The upper resistive layer 10 and test area 13 are then simultaneously screen printed. Layer 10 is screen printed over the conductive covers 8, 15, the lower resistive layer 9 and base 2 while test area 13 is screen printed directly on base 2. The printing material is a heat fusible carbon paste sold by Asahi Chemical Co., Ltd. under the designation BTU-3K. The binder in the paste is then hardened by a thermoset process, thereby completing the construction of base 2.

The resistive element 14 gradually becomes frayed by the sliding movement of the brush 4 thereover. However, because the resistive element 14 has a two-layer structure, the reliability and particularly the durability of the resistive element 14 is maintained. It will readily be appreciated that a thin upper resistive layer 10 is not preferred.

The thickness of the lower and upper resistive layers 9, 10 must be very accurately controlled in order to produce good repeatability of all resistive values of the variable resistor A. It can readily be seen that the resistive value of resistor A will vary in accordance with the thickness of the lower resistive layer 9 especially when the volume inherent resistance of the lower resistive layer 9 is low.

A uniform thickness of the conductive covers 8, 15 is also important for maintaining the reliability of the electrical connection between the resistive element 14 and the copper foil electrodes 7A and 7B. Furthermore, the lower resistive layer 9 must not be too thin.

Thus, the thickness of the conductive covers 8, 15 and the thickneses of the lower and upper resistive layers 9, 10 must be accurately controlled when manufacturing the base 2. However until now, it has been extremely difficult to accurately measure these thicknesses during or after manufacturing without destroying the resistor.

Likewise, in the resistor A of the present invention, the portions of the conductive covers 8, 15 deposited directly on the copper foil electrodes 7A and 7B are very thin. Typically, the electrodes 7A and 7B have a thickness of only about 35 um. Furthermore, those portions of conductive covers 8, 15 which are deposited directly on the plate 6 have a width of generally less than 1 mm. Thus, the thicknesses of the conductive covers 8, 15 and the thickness of the lower resistive layer 9, in the regions where the conductive covers 8, 15 abut the resistive layer 9, cannot be accurately measured. It is also difficult to measure the thickness of the lower resistive layer 9 after the upper resistive layer 10 is laminated thereon. Likewise, the thickness of the upper resistive layer 10 cannot be measured after the two-layer resistive element 14 has been formed because the upper resistive layer 10 is laminated onto the lower resistive layer 9.

In order to overcome the inherent difficulties in measuring the thicknesses of the conductive covers 8, 15 and the thicknesses of the resistive layers 9 and 10, the test areas 11, 12 and 13 are formed on the base 2 at a location closely adjacent the operational portions of the resistor A (i.e., closely adjacent conductive covers 8, 15, resistive layers 9, 10 and electrodes 7) as best shown in FIG. 2.

The test areas 11, 12 and 13 are preferably formed as follows: test area 11 is screen-printed onto base 2 simultaneously with conductive covers 8, 15. The material used to print test area 11 is preferably the same as is used to print conductive covers 8, 15. Conductive covers 8, 15 and test area 11 are then simultaneously thermoset, so that the respective thicknesses of covers 8, 15 and area 11 are substantially the same. Thus, when the thickness of test area 11 is measured, the thickness of conductive covers 8, 15 may be accurately estimated.

Similarly, test areas 12, 13 are simultaneously screen-printed and thermoset with lower and upper resistive layers 9 and 10, respectively. The thickness of layer 9 and the thickness of layer 10 may likewise be estimated by measuring the thickness of test area 12 and the thickness of test area 13, respectively.

As will be readily appreciated by those skilled in the art, the thickness of test areas 11, 12, 13 can be measured without destroying the integrity of the operational portions of the variable resistor A. Thus, the present invention is very useful in controlling the thickness of the individual layers in a laminated composite comprising one or more conductive cover layers and one or more resistive layers, to assure product reliability, for making shipment inspections, and to accurately measure the thickness of the layers upon inspection after manufacturing.

The screen printed test areas 11, 12 and 13 are preferably formed in a shape having a width and axis which corresponds to (i.e., the width is equal to and the axis is parallel to) the width and axis of at least a portion of the conductive covers 8, 15 and lower and upper resistive layers 9, 10, respectively.

During simultaneous screen printing of a test area and a conductive cover or a resistive layer, it is preferable to locate the test area as near as possible to the conductive cover or resistive layer since the thicknesses of the test area and the conductive cover or resistive layer have a tendency to become unequal when the distance between them is too great. Therefore it is desirable that each of the test areas 11, 12 and 13 be located adjacent to their respective conductive cover or resistive layer 8, 15, 9 and 10.

Figure 4:
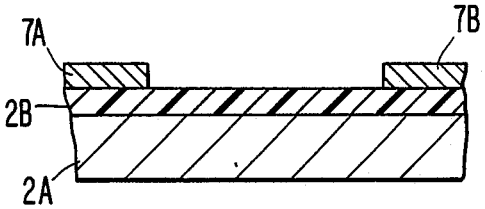
FIG. 4 is a sectional view of another embodiment of the base and electrodes according to the present invention.

As shown in FIG. 4, the base 2 preferably has a laminated construction including an insulating layer 2B formed of materials such as an epoxy resin, an epoxy resin containing glass fibers, an epoxy resin containing dispersed alumina or paper impregnated with a phenolic resin. The insulating layer 2B is laminated to a metallic layer 2A composed of a metal such as iron, aluminum, etc.

The variable resistor A of the present invention has the following characteristics:

(1) The thickness of the individual conductive covers and resistive layers of a laminated element can be accurately measured and controlled thereby allowing quality assurance to be accurately performed.

(2) The thickness of the individual layers in a laminated resistive element can be independently measured, so the assurance of a standard resistive value is maintained.

(3) When the size and orientation of the test areas are made to correspond with the size and orientation of the corresponding conductive cover layer or resistive layer, the accuracy in estimating the thickness of the conductive covers or resistive layers (by measurement of the thickness of the corresponding test areas) is improved.

(4) The base supporting the resistive element is made from aluminum or iron having a low electric resistance and is separated by an insulating material from the resistive element. Any electro-magnetic wave is absorbed or reflected, so that a sealing effect on the electro-magnetic wave and on the magnetism (if iron is used) is obtained.

(5) Aluminum and iron have good thermal conductivity, so that the Joule's heat generated by the resistive element is quickly radiated and the maximum allowable power rating of the resistor can be increased.

(6) The base with a metallic plate will not easily short circuit (ignite), even when used in high current applications, and thus the safety of the variable resistor is improved for use in vehicles.

Since many different embodiments of the present invention can be made without departing from the spirit and scope thereof, it is to be understood that the invention is not limited to the specific embodiments illustrated herein, but rather is defined by the appended claims.

We claim:

1. A variable resistor comprising:

an insulating base;

first, second and third electrodes on said base;

a resistive element on said base and extending between said first electrode and said second electrode;

a first conductive cover layer providing a conductive contact between the resistive element and the first electrode;

a second conductive cover layer providing a conductive contact between the resistive element and the second electrode;

a contact member slidably disposed over said resistive element, said contact member being in sliding conductive contact with said resistive element and in conductive contact said third electrode;

a first test area on said base, said first test area having substantially the same thickness as said resistive element and being provided for estimating the thickness of said resistive element;

a second test area on said base, said second test area having substantially the same thickness as each of said conductive layers and being provided for estimating the thickness of said conductive cover layers.

2. The variable resistor of claim 1, wherein said first test area is formed simultaneously with said resistive element and said second test area is formed simultaneously with said conductive cover layers.

3. A variable resistor comprising:

an insulating base;

first, second and third electrodes mounted on said base;

a resistive element formed on said base;

a first conductive cover layer formed on said base and providing a conductive contact between said first electrode and said resistive element;

a second conductive cover layer formed on said base and providing a conductive contact between the resistive element and the second electrode;

said resistive element comprising (i) a lower resistive layer formed on the base and contacting the conductive cover layers and (ii) an upper resistive layer, said upper layer being in conductive contact with said conductive cover layers, said lower resistive layer, and said first and second electrodes;

a contact member slidably disposed over said resistive element, said contact member being in sliding conductive contact with said upper resistive layer and in conductive contact with said third electrode;

a first test area on said base, said first test area having substantially the same thickness as said lower resistive layer and being provided for estimating the thickness of said lower resistive layer;

a second test area on said base, said second test area having substantially the same thickness as said upper resistive layer and being provided for estimating the thickness of said upper resistive layer; and a third test area on said base, said third test area having substantially the same thickness as each of said conductive cover layers and being provided for estimating the thickness of said conductive layers.

4. The variable resistor of claim 3, wherein said first test area is formed simultaneously with said lower resistive layer, said second test area is formed simultaneously with said upper resistive layer, and said third test area is formed simultaneously with said conductive cover layers.

5. The variable resistor of claim 3, wherein the volume inherent resistive value of said upper resistive layer is from 2 to 500 times the resistive value of said lower resistive layer.

6. The variable resistor of claim 3, wherein said base comprises a laminate of an insulating material on a metallic material.

7. The variable resistor of claim 6, wherein said metallic material comprises aluminum.

8. The variable resistor of claim 6, wherein said metallic material comprises iron.

9. The variable resistor of claim 6, wherein said insulating material comprises an epoxy resin.

10. The variable resistor of claim 9, wherein said epoxy resin contains glass fibers.

11. The variable resistor of claim 9, wherein said epoxy resin contains dispersed silica and/or alumina.

* * * * *

UNITED STATES PATENT AND TRADEMARK OFFICE

CERTIFICATE OF CORRECTION

PATENT NO. : 4,864,273

DATED : September 5, 1989

INVENTOR(S) : Takayoshi Tsuzuki, Mitsuko Kotaki, Ryohei Yabuno & Masami Ishii

It is certified that error appears in the above-identified patent and that said Letters Patent is hereby corrected as shown below:

On the title page:

[75] The First Named Inventor Should Be Changed From [Takoyoshi Tsuzuki] to --Takayoshi Tsuzuki--.

Signed and Sealed this

Second Day of July, 1991

*Attest:*

HARRY F. MANBECK, JR.

*Attesting Officer*

*Commissioner of Patents and Trademarks*